US007721903B2

(12) United States Patent
Ben Afeef

(10) Patent No.: US 7,721,903 B2
(45) Date of Patent: May 25, 2010

(54) OVERFLOW DRAINAGE SYSTEM FOR FLOATING ROOF STORAGE TANK

(75) Inventor: Mohammed A. Ben Afeef, Jeddah (SA)

(73) Assignee: Saudi Arabian Oil Company, Dhahran (SA)

( * ) Notice: Subject to any disclaimer, the term of this patent is extended or adjusted under 35 U.S.C. 154(b) by 383 days.

(21) Appl. No.: 11/647,779

(22) Filed: Dec. 28, 2006

(65) Prior Publication Data

US 2008/0155918 A1 Jul. 3, 2008

(51) Int. Cl.
*B65D 88/38* (2006.01)
*B65D 88/34* (2006.01)

(52) U.S. Cl. ..... 220/219; 220/216; 220/227

(58) Field of Classification Search ..... 220/219, 220/216, 227
See application file for complete search history.

(56) References Cited

U.S. PATENT DOCUMENTS

| | | | | |
|---|---|---|---|---|
| 2,560,586 | A | 7/1951 | Michaels | |
| 2,563,017 | A | 8/1951 | Feild | |
| 2,846,109 | A | 8/1958 | Larsen | |
| 2,913,138 | A | 11/1959 | Swick | |
| 2,931,534 | A | 4/1960 | Wiggins | |
| 3,074,587 | A | 1/1963 | Jennings | |
| 3,329,301 | A | 7/1967 | Lee | |
| 3,579,657 | A | 5/1971 | Gurrieri | |
| 3,667,641 | A | 6/1972 | Dial | |
| 3,883,032 | A | 5/1975 | Fisher | |
| 4,134,515 | A | 1/1979 | Hills et al. | |
| 4,202,366 | A | 5/1980 | Kamvachirapitag | |
| 4,248,357 | A | 2/1981 | Stafford | |
| 4,431,536 | A | 2/1984 | Thompson | |
| 4,470,437 | A | 9/1984 | Rabinovich | |
| 4,512,883 | A | 4/1985 | Thompson | |
| 4,706,718 | A * | 11/1987 | Milo | 141/86 |
| 4,790,446 | A | 12/1988 | Thiltgen | |
| 5,605,243 | A | 2/1997 | Jolly | |
| 5,680,950 | A | 10/1997 | Jolly | |
| 5,758,792 | A | 6/1998 | Jolly | |
| D452,899 | S | 1/2002 | Salisbury | |
| D485,889 | S | 1/2004 | DuBois | |
| 6,966,982 | B1 * | 11/2005 | Chang | 210/150 |

FOREIGN PATENT DOCUMENTS

| | | |
|---|---|---|
| JP | 5077883 | 3/1993 |
| JP | 05077883 A * | 3/1993 |

* cited by examiner

*Primary Examiner*—Anthony Stashick
*Assistant Examiner*—Niki M Eloshway
(74) *Attorney, Agent, or Firm*—Abelman, Frayne & Schwab

(57) ABSTRACT

A drain cover assembly for sealing a drain pipe that extends vertically from the top surface of the deck of a floating roof on a liquid storage tank includes a circular cover and at least two buoyant members, or pontoons, secured to the underside of the cover for imparting a buoyant force to raise the cover upon the accumulation of excess water on the deck. The pontoons are spaced apart from each other to allow water to pass between them and into the drainpipe.

27 Claims, 2 Drawing Sheets

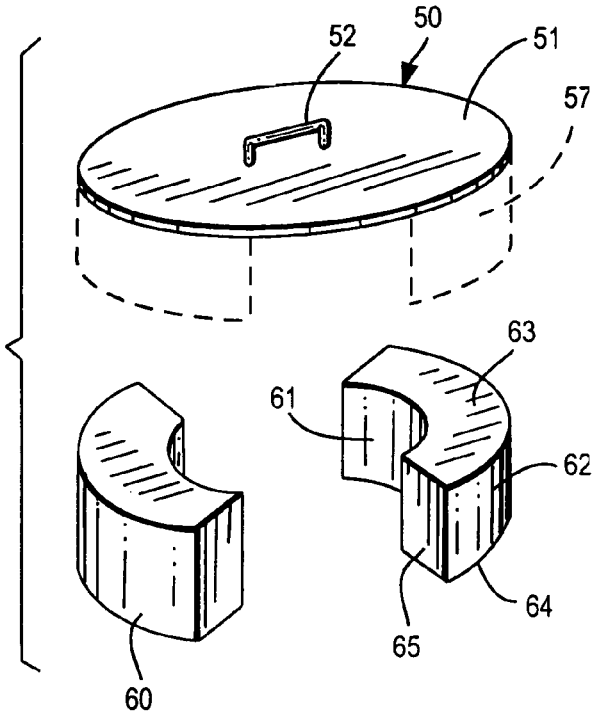
FIG. 3
FIG. 2
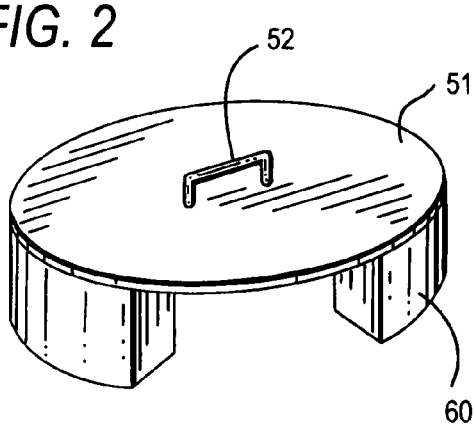
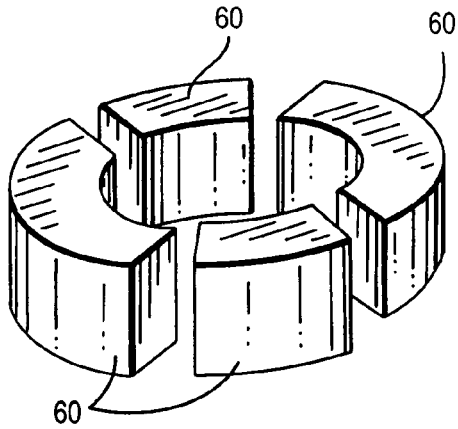
FIG. 4
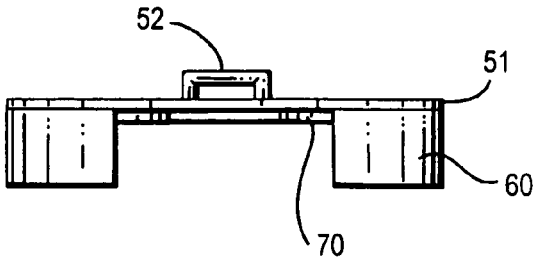
FIG. 5

OVERFLOW DRAINAGE SYSTEM FOR FLOATING ROOF STORAGE TANK

FIELD OF THE INVENTION

The present invention relates to a drainage device for use on a floating roof on a storage tank for liquid products.

BACKGROUND OF THE INVENTION

Storage tanks for oil and other liquid hydrocarbon products are typically provided with a floating roof. The floating roof moves vertically on the surface of the liquid product to prevent the escape of harmful vapors. A typical floating roof for covering a liquid product in a storage tank includes a deck that substantially conforms to the horizontal cross-sectional shape of the storage tank and has a vertical thickness. The roof is provided with one or more seals extending between the outer periphery of the floating roof and the inner wall of the tank. The roof floats on top of the stored liquid product and rises and falls as the amount of the liquid product increases and decreases. It is known to provide a drain pipe extending vertically through the top surface of deck to drain accumulated water and provide a passage or conduit for the water. The water drained from the surface of the roof passes through the stored liquid and accumulates at the bottom of the tank where it is eventually drained from the tank.

During seasonal or other periods of heavy rains, the amount of water that accumulates over the area of the tank cover can be substantially greater than that which can be removed by the centrally positioned drain. The water will therefore rise and can inundate the drain sealing mechanism. The presence of debris carried by the accumulating water can interfere with the proper operation of complex roof drain apparatus known to the prior art.

A further problem can occur when rainwater accumulates on the roof and its effective weight increases to a point where it can overcome the buoyancy of the roof, eventually forcing it into the liquid in the tank. It is therefore important to provide an effective and reliable means for draining water from the roof so that it does not exceed a pre-determined depth and weight.

Various approaches have been proposed for draining water from storage tank floating roofs. For example, U.S. Pat. No. 2,560,586 to Michaels discloses a floating roof drain which drains water collected over a valve of the floating roof which closes and opens a drain passing. The weight of the water collected over the valve pushes down a cover against the buoyancy force of a float connected to the valve to allow the water collected to flow from the roof. The valve is again closed when the depth of the water on the roof decreases until it is no longer sufficient to hold the valve open against the buoyancy force of the float.

U.S. Pat. No. 2,913,138 to Swick describes floating covers for tanks in which a drainage device is located at a low point of the roof structure in a deck. The drainage device comprises a cylindrical sump, a sump bottom formed with a shallow depression which constitutes a downward flow passage, a cylindrical neck extending from the bottom of the sump and an annular float member loosely surrounding the sidewall of the neck. A mercury seal is provided on the bottom and the float member rests on the bottom of the pool of mercury. Accumulated water in the sump buoys up the float member to interrupt the mercury seal and thereby provide a conduit for water to drain across the surface of the pool.

U.S. Pat. No. 3,883,032 to Fisher discloses an automatic drain valve for a floating roof which includes an orifice and a larger disk located under the orifice. A float attached to the disk allows the valve to be biased closed and water gathered on top of the roof will open the valve which permits the water to drain through the roof into the tank beneath to join the body of liquid product with the tank.

Japanese Patent No. JP5077883 to Kunio discloses an emergency drain device for a floating roof in which a drain pipe runs through a deck up to stored liquid in a tank and a float, which floats on accumulated liquid on the deck and is on an upper end of the drain pipe, prevents vapor from flowing out of the drain pipe. A weight-attached guide member makes the float return to the upper end of the drain pipe.

The above systems for draining water from floating roofs do not overcome the problems of reliability, performance under extreme conditions and secure sealing of the drain opening associated with floating roofs. That is, unfavourable weather conditions, such as high winds and a significant accumulation of rainwater, may cause the roof to sink. Another problem to be considered is evaporation losses of liquid product stored in the tank.

It is, therefore, an object of the present invention to provide an apparatus for effectively and reliably draining accumulated rain water from a floating roof on a liquid product tank by a self-opening and closing mechanism for a floating roof drain.

Another object of the invention is to provide an apparatus for draining accumulated rain water from the top of a roof on a liquid product tank which reduces product evaporation losses to the atmosphere.

A further object of the invention is to provide an automatic roof drain apparatus that is of simple and rugged construction and inexpensive to manufacture and install.

SUMMARY OF THE INVENTION

The above objects, as well as other advantages described herein, are achieved by a buoyant drain cover assembly for releasably sealing a drain pipe projecting from the surface of the floating roof assembly that comprises a drain pipe sealing cover secured to a plurality of depending buoyant members spaced apart from each other and configured to conform to the exterior of the projecting drain pipe and that permit vertical movement of the assembly relative to the projecting pipe. The assembly moves from a sealed position in which the assembly is supported by the top rim of the drain pipe, to an open position in which the buoyant members floating in water accumulated on the roof lift the cover from the rim of the drain. As the water is drained and the level subsides, the assembly is lowered relative to the drain pipe and the cover contacts and reseals the supporting rim of the drain pipe.

In a preferred embodiment, the portion of the underside of the cover resting on the rim of the drain pipe is provided with a sealing surface, which can be a polymeric material, such as PTFE, an engineering grade of nylon, HDPE or other wear and abrasion-resistant material. The seal is configured to engage the drain pipe rim, taking into account that the cover assembly must be sufficiently spaced from the exterior of the projecting pipe to permit free vertical movement as the water level rises and falls. In a further preferred embodiment, the projecting drain pipe terminates in a flanged contact surface, which contact surface can also be provided with a coating or layer of material to form a seal.

The buoyant members are preferably formed from a molded polymer foam having an exterior skin that is relatively smooth and resistant to abrasion and tearing. Two or more members are secured to the cover with a corresponding number of vertical spaces or flow paths between them to allow the water to flow into the drain pipe. In a preferred embodiment, two, three or four arcuate members are equidistantly positioned around a circular drain pipe with about a one-half inch or 13 mm clearance between the outer surface of the pipe and the corresponding contour of the buoyant member. Circumferential gaps between the buoyant members are provided to allow water to flow from the roof into the top of the open drain pipe.

The bottom surface of the buoyant members can be flat and when in position the closed supported position with the cover sealing the rim of the drain pipe the bottom is positioned at least one-half inch or 13 mm above the roof surface. As will be apparent to one of ordinary skill in the art, the precise dimensions, configuration, materials of construction and positioning of the assembly can be varied to provide the desired combination of a secure seal when the water level drops the cover on the rim of the drain pipe.

The improved cover assembly of the invention lifts the cover in order to drain accumulated water from the top of the roof reliably and automatically. The drainpipe and cover are preferably circular and at least two buoyant members, sometimes referred to as "pontoons", are secured to the underside of the cover at the rim for imparting an upward buoyant or lifting force to the cover when immersed in a sufficient level of water on the deck. The pontoons are spaced apart from each other to allow water to pass between them and into the drain pipe.

The drain pipe preferably extends into, and terminates below the surface of the liquid in the tank in order to minimize the amount of vapors that might be displaced from the tank into the environment.

The seal is secured to the underside of the drain cover and provides a vapor-tight closure with the drain pipe against passage of vapors from the interior of the tank below. The improved cover of the present invention is configured to sealingly mate with the upper portion or rim of the drain pipe that extends above the top surface of the roof deck. Drain pipes are customarily round, but can be of any shape, and the underside of the cover is provided with a mating seal. For reasons of convenience and economy, a round drain pipe and mating cover and seal are preferred.

The underside of the cover is provided with a seal fabricated from a weather and wear-resistant material. The seal can be applied in the shape of a ring, a circular panel or can cover the entire underside of the cover. Other configurations and materials known in the art can be utilized.

The cover can be planar or provided with a depending rim, or flange. It is preferably provided with a handle or other projecting element(s) to facilitate lifting it into position on the end of the drainpipe. The cover is preferably fabricated from steel plate or other metal that is of sufficient thickness to assure that its weight will resist displacement, e.g., by wind, once it is installed on the drain pipe. Auxiliary retaining means can be provided to secure the cover against the risk of displacement during unexpectedly high wind conditions and the like. Selection of such safety devices will be apparent to those of ordinary skill in the art and do not form a part of the present invention. The size of the drain pipe and floatation members are selected to assure that water does not accumulate to a level that would permit the cover assembly to float out of alignment with the drain pipe.

The cover is secured to a plurality of buoyant members of a size and configuration that permit the cover to rest on, and seal the top of the drain pipe when there is less than a predetermined depth of water on the roof. As will be understood by one of ordinary skill of the art, the height of the end of the drain above the roof deck will determine the maximum depth of water that will be allowed to accumulate on the floating roof. In order to provide a secure seal, the floatation members must be supported above the deck, i.e., they must not be resting on the deck. The buoyant force attributed to the floatation members must be sufficient to raise the cover from the end of the drain pipe when the accumulated water reaches a predetermined depth that is greater than the height of the top of the pipe. When the cover is lifted by the buoyant force, the excess water enters the drain and as the level of water drops, the cover eventually settles downwardly into position to reseal the drain.

In a particularly preferred embodiment, the buoyant members are configured so that the surfaces facing the drain pipe generally conform in shape to the exterior contour of the pipe. The buoyant member will thus serve to keep the cover generally centered over the pipe to assure a proper sealing relation when the water has been drained away. The exterior of the drain pipe can be coated with a low-friction industrial paint or polymer to further assure the free relative movement of the assembly.

The surface of the floatation material adjacent the drain pipe can be provided with an abrasion-resistant or low friction coating or finish to further assure free movement during the vertical movement of the cover structure. The floatation members can be constructed entirely of a molded foamed polymer, from molded or spun cast polyethylene, or from other materials that will be apparent to those of ordinary skill in the art. The buoyant members can be produced as a unitary element, joined by reinforcing structural members and/or bonded together by adhesive.

As noted above it is important to provide floatation members that will support the cover for resealing after excess water is drained from the roof. Gaps between the members must be provided to permit the water to flow freely into the open drain pipe. In preferred embodiments, two, three or four members are secured to the cover, evenly spaced about it periphery.

BRIEF DESCRIPTION OF THE DRAWINGS

The invention will be further described in detail in conjunction with the accompanying drawings in which:

FIG. 2 is a top perspective side view of a circular drain cover with multiple pontoons;

FIG. 3 is an exploded view of the drain cover of FIG. 2;

FIG. 4 is a perspective view of another embodiment showing four pontoons in spaced relation prior to attachment to the cover;

FIG. 5 is a side elevation view of the drain cover of FIG. 2; and

Figure 1:
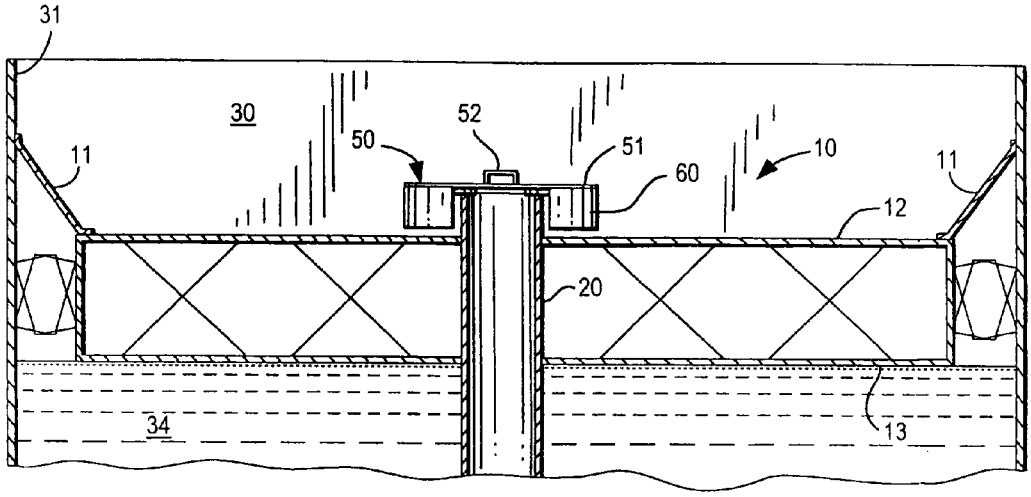
FIG. 1 is a cross-sectional view of a floating roof equipped with the drainage apparatus of the present invention and the closed or sealed position.

To facilitate an understanding of the invention, the same reference numerals have been used, when appropriate, to designate the same or similar elements that are common to the figures. Unless stated otherwise, the features shown and described in the figures are not drawn to scale, but are shown for illustrative purposes only.

DETAILED DESCRIPTION OF THE INVENTION

Referring to FIG. 1, a floating roof 10 is supported by, and floats on a liquid product 34 and sealingly engages the sidewall 31 of tank 30 with a resilient sealing structure 11. The floating roof moves up or down vertically with the level of the liquid product inside the tank. The floating roof 10 has a substantially circular form which conforms to the cross-section of the tank and includes a top deck 12 and a bottom deck 13 joined by an intermediate structure.

A drain pipe 20 projects vertically from the top deck of the roof 10 and through the two decks 12, 13, to provide a passage for drainage of accumulated water from the top deck 12, into the liquid in the tank.

Referring to the embodiment shown in FIGS. 1-4, a circular drain cover assembly 50 is mounted on the buoyant pontoons 60 around the drain pipe 20. A flat circular cover plate 51 has a diameter greater than that of the drain pipe 20. A handle or other fitting 52 is secured to the top of the center of the plate 51 for lifting the cover assembly.

With reference to FIGS. 2-4, two arcuate pontoons 60 are secured, e.g. by adhesive bonding to the underside of the circular cover plate 51 at its rim. Each pontoon 60 has an inner wall 61, an outer wall 62, a top 63, and a bottom 64 and sidewalls 65 adjoining the inner and the outer walls 61, 62. The size of the pontoon 60 is determined in order to provide the necessary buoyancy, or force, to lift up the circular plate 51. In a preferred embodiment, at least two pontoons 60 are attached to the plate 51 and a gap of predetermined distance is maintained between the pontoons to provide a water passage. The distance is determined based on the required flow rate of accumulated water on the top deck 12. The greater the distance, the faster the flow rate. The number of pontoons 60 can vary as long as the spaces between them are adequate to permit the desired flow rate of accumulated water on the top deck 11 into the drain pipe 20.

Referring again to FIG. 1, a gap is maintained between the bottom 64 of the pontoons and the top deck 12 in order to ensure that the drain cover will securely seal the drainpipe 20 and provide good vapor sealing. The gap is preferably 0.5 inch. A gap is also maintained between the drain pipe 20 and the inner cylindrical wall 61 of the pontoon to ensure free vertical movement of the drain cover assembly 50. The gap is preferably 0.5 inch.

Referring to FIG. 5, the drain pipe 20 supports plate 51 and a seal 70 attached to the underside of the plate 51. The seal 70 serves to substantially prevent fluid losses from the tank and drain pipe.

Figure 6:
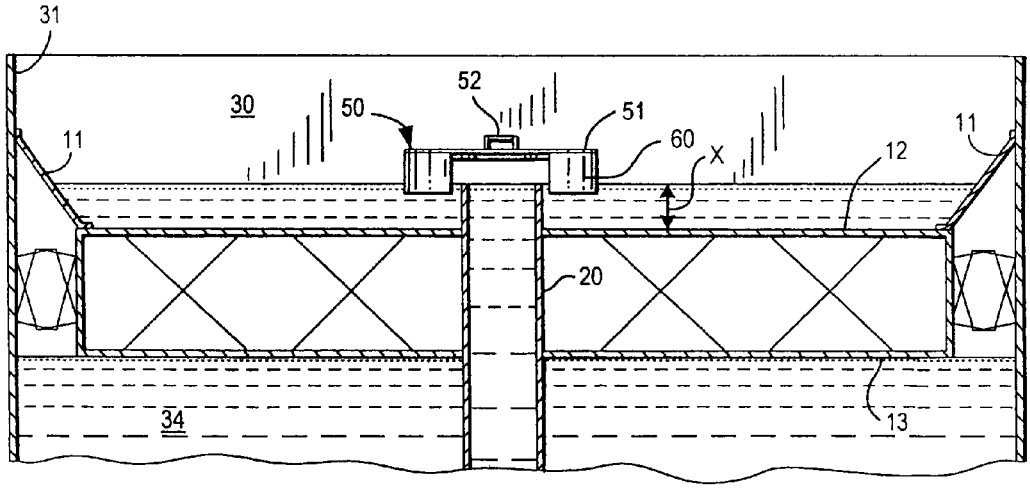
FIG. 6 illustrates the drainage of accumulated water from the water on top of the roof of FIG. 1.

Referring now to FIG. 6, when the accumulated rain water on the top deck 12 of the roof reaches a predetermined level, the buoyant force of the pontoons 60 lifts drain cover assembly 50 and the accumulated rain water on the top deck 12 flows into the drain pipe 20 through the space between the pontoons 60 and the level of rain water on top deck 12 is thereby maintained below predetermined maximum level "X". Thus, an automatic control of the water level on the roof is provided by the buoyancy of the pontoons and the roof is prevented from sinking into the stored liquid product.

Although various embodiments that incorporate the teachings of the present invention have been shown and described in detail above, those of ordinary skill in the art can readily devise other and varied embodiments, and the scope of the invention is to be determined by the claims that follow.

I claim:

1. An automatic drain assembly for a floating roof covering a liquid product stored in a tank, said roof including a deck with top and bottom surfaces, said drain pipe having an open top end and an opposite open bottom end, the drain assembly comprising:

(a) a drain pipe extending from a predetermined elevation at a maximum allowable level for accumulated water above said top surface of said floating roof, downward through said roof, providing a conduit for water to be drained from said deck, said drain pipe having an open top end and an opposite open bottom end, (b) a drain pipe sealing cover lying by its weight in its closed position atop said open top end of said drain pipe, said cover having opposite top and underside surfaces, and (c) at least two buoyant members secured in spaced apart relation to the underside of the cover forming a collar that at least partially surrounds said top end of said drain pipe. for imparting a buoyant force from water accumulated on said deck to lift said cover from said closed position where it lies and is sealed against said top end of said drain pipe to an open position where it is spaced above said open top end of said drain pipe, to thereby allow water to flow into the drain pipe, said cover adapted to be repeatedly moved between its closed and open positions as required to drain water from said deck.

2. The drain assembly of claim 1, wherein said drain pipe open top end is defined by a peripheral rim, said drain assembly comprising a seal secured to the underside of the drain cover for sealing said cover against said the rim of the drain pipe.

3. The drain assembly of claim 1 in which the drainpipe is round in cross-section and each of the buoyant members has an arcuate shaped inner and outer sidewall and a generally rectangular vertical cross-section.

4. The drain assembly of claim 1, wherein the bottom of the buoyant members are a predetermined distance from the top surface of the deck when the cover is in said closed position on the drain pipe.

5. The drain assembly of claim 1, wherein the inner sidewalls of the buoyant members are spaced a predetermined distance from the outer surface of the drainpipe when said cover is in said closed position.

6. The drain assembly of claim 1, wherein the drain pipe has a round cross-section about a central longitudinal axis, and said buoyant members are concentrically positioned about said drain pipe.

7. A drain cover assembly for a drain pipe that has an open top end and an opposite bottom end, and extends vertically from an elevation that is the predetermined maximum allowable level for water to accumulate atop said roof before said automatic drain assembly begins to drain said accumulated water, said cover assembly comprising:

a cover plate situated above and adjacent said open top end of said drain pipe, said cover having opposite top and underside surfaces, where the underside is adapted to cover the top of the drain pipe; and at least two pontoons secured to said underside surface and forming a collar that at partially surrounds said top end of said drain pipe for imparting a buoyant force from water accumulated on said deck to lift said cover plate from a closed position where it lies and is sealed against said top end of said drain pipe to an open position where it is spaced above said open top end of said drain pipe, the pontoons being spaced apart from each other to allow water to flow through to the drain pipe.

8. The cover assembly of claim 7, wherein each of the pontoons has an arcuate shaped inner and outer sidewall and a generally rectangular vertical cross-section.

9. The cover assembly of claim 7, wherein a seal is secured to the underside of the drain cover inside the pontoons for sealing the drain pipe.

10. The cover assembly of claim 7, wherein a predetermined spacing is provided between the exterior of the drain pipe and the inner sidewall of the pontoons.

11. The cover assembly of claim 7, wherein the drain pipe and the pontoons are concentrically positioned around the center of the cover.

12. The cover assembly of claim 7 in which the cover plate is provided with a downwardly depending flange that extends over at least a portion of the buoyant members.

13. The cover assembly of claim 12 in which the cover plate is steel and the flange is sheet metal.

14. The cover assembly of claim 7 which includes a fitting secured to the upper surface of the cover plate for lifting the assembly.

15. The cover assembly of claim 7 in which the pontoons are molded polymeric foam.

16. The cover of claim 15 in which the molded foam pontoons are integrally formed with a solid, abrasion resistant skin.

17. An automatic drain assembly for a floating roof covering a liquid product stored in tank, said roof including a deck with top and bottom surfaces said drain assembly comprising:

(a) a drain pipe having an open top end at an elevation that is the predetermined maximum allowable level for water to accumulate top said roof, (b) a drain pipe sealing cover lying by its weight in its closed position atop said open top end of said drain pipe, said cover having opposite top and underside surfaces, and (c) at least one buoyant member secured to said cover and forming a collar at least partially surrounding said top end of said drain pipe, for imparting a buoyant force from water accumulated on said deck to lift said cover from said closed position where it lies and is sealed against said top end of said drain pipe to an open position where it is spaced above said open top end of said drain pipe, to thereby allow water to flow into the drain pipe, said cover adapted to be repeatedly moved between its closed and open positions as required to drain water from said deck.

18. A cover according to claim 17 wherein said at least one buoyant member is secured to the underside of said cover.

19. An automatic drain assembly for a floating roof covering a liquid product stored in tank, said roof including a deck and a drain pipe extending vertically from the top surface of the deck and providing a conduit for water to be drained from the deck, said drain pipe having an open top end and an opposite bottom end, the drain assembly comprising:

(a) a drain pipe sealing cover lying by its weight in its closed position atop said open top end of said drain pipe, said cover having opposite top and underside surfaces, and (b) at least two buoyant members secured in spaced apart relation to the underside of the cover for imparting a buoyant force from water accumulated on said deck to lift said cover from said closed position where it lies and is sealed against said top end of said drain pipe to an open position where it is spaced above said open top end of said drain pipe, to thereby allow water to flow into the drain pipe, said cover adapted to be repeatedly moved between its closed and open positions as required to drain water from said deck, and wherein said drain pipe open top end is defined by a peripheral rim, said drain assembly comprising a seal secured to the underside of the drain cover for sealing said cover against said the rim of the drain pipe.

20. An automatic drain assembly for a floating roof covering a liquid product stored in tank, the roof including a deck and a drain pipe extending vertically from the top surface of the deck and providing a conduit for water to be drained from the deck, said drain pipe having an open top end and an opposite bottom end, the drain assembly comprising:

(a) a drain pipe sealing cover lying by its weight in its closed position atop said open top end of said drain pipe, said cover having opposite top and underside surfaces, and (b) at least two buoyant members secured in spaced apart relation to the underside of the cover for imparting a buoyant force from water accumulated on said deck to lift said cover from said closed position where it lies and is sealed against said top end of said drain pipe to an open position where it is spaced above said open top end of said drain pipe, to thereby allow water to flow into the drain pipe, said cover adapted to be repeatedly moved between its closed and open positions as required to drain water from said deck, wherein said drainpipe is round in cross-section and each of the buoyant members has an arcuate shaped inner and outer sidewall and a generally rectangular vertical cross-section.

21. An automatic drain assembly for a floating roof covering a liquid product stored in tank, the roof including a deck and a drain pipe extending vertically from the top surface of the deck and providing a conduit for water to be drained from the deck, said drain pipe having an open top end and an opposite bottom end, the drain assembly comprising:

(a) a drain pipe sealing cover lying by its weight in its closed position atop said open top end of said drain pipe, said cover having opposite top and underside surfaces, and (b) at least two buoyant members secured in spaced apart relation to the underside of the cover for imparting a buoyant force from water accumulated on said deck to lift said cover from said closed position where it lies and is sealed against said top end of said drain pipe to an open position where it is spaced above said open top end of said drain pipe, to thereby allow water to flow into the drain pipe, said cover adapted to be repeatedly moved between its closed and open positions as required to drain water from said deck, wherein said inner sidewalls of the buoyant members are spaced a predetermined distance from the outer surface of the drainpipe when said cover is in said closed position.

22. A drain cover assembly for a drain pipe that has an open top end and an opposite bottom end, and extends vertically from a floating roof of a liquid storage tank in order to permit the removal of excess water from the roof, the cover assembly comprising:

a cover plate situated above and adjacent said open top end of said drain pipe, said cover having opposite top and underside surfaces, where the underside is adapted to cover the top of the drain pipe; and at least two pontoons secured to said underside surface for imparting a buoyant force from water accumulated on said deck to lift said cover plate from a closed position where it lies and is sealed against said top end of said drain pipe to an open position where it is spaced above said open top end of said drain pipe, the pontoons being spaced apart to allow water to flow through to the drain pipe, wherein each of said pontoons has an arcuate shaped inner and outer sidewall and a generally rectangular vertical cross-section.

23. A drain cover assembly for a drain pipe that has an open top end and an opposite bottom end, and extends vertically from a floating roof of a liquid storage tank in order to permit the removal of excess water from the roof, the cover assembly comprising:

a cover plate situated above and adjacent said open top end of said drain pipe, said cover having opposite top and underside surfaces, where the underside is adapted to cover the top of the drain pipe;

at least two pontoons secured to said underside surface for imparting a buoyant force from water accumulated on said deck to lift said cover plate from a closed position where it lies and is sealed against said top end of said drain pipe to an open position where it is spaced above said open top end of said drain pipe, the pontoons being spaced apart to allow water to flow through to the drain pipe, and a seal is secured to the underside of the drain cover inside the pontoons for sealing the drain pipe.

24. An automatic drain assembly for a floating roof covering a liquid product stored in tank, the roof including a deck and a drain pipe extending vertically from the top surface of the deck and providing a conduit for water to be drained from the deck, said drain pipe having an open top end and an opposite bottom end, the drain assembly comprising:

(a) a drain pipe sealing cover lying by its weight in its closed position atop said open top end of said drain pipe, said cover having opposite top and underside surfaces, and (b) at least two buoyant members secured in spaced apart relation to the underside of the cover for imparting a buoyant force from water accumulated on said deck to lift said cover from said closed position where it lies and is sealed against said top end of said drain pipe to an open position where it is spaced above said open top end of said drain pipe, to thereby allow water to flow into the drain pipe, said cover adapted to be repeatedly moved between its closed and open positions as required to drain water from said deck, said cover plate being provided with a downwardly depending flange that extends over at least a portion of the buoyant members.

25. An automatic drain assembly for a floating roof adapted to float atop a liquid product stored in tank, said roof including vertically spaced top and bottom surfaces, said drain assembly comprising:

(a) a drain pipe extending from below said bottom surface upward through said floating roof and projecting upward above said top surface to an elevation that is a predetermined maximum allowable level for water to accumulate atop said top surface, said drain pipe having open top and bottom ends and open communication between said ends for water accumulated atop said top surface to drain downward through said drain pipe, (b) a sealing cover having a closed position when it is lying by its weight atop and closing said open top end of said drain pipe, and having an open position when it is spaced above said open end of said drain pipe, said cover having opposite top and bottom surfaces, (c) at least one buoyant member secured to said cover for imparting a buoyant force from water accumulated on said top surface of said top deck to lift said cover from said closed position to said open position, to thereby allow water to flow into and down said drain pipe, said cover adapted to repeatedly and automatically float from said buoyant force upward from said closed to said open whenever water accumulates to a level above said maximum allowable level above said top surface of said top deck, said at least one buoyant member extends downward from the bottom surface of said cover and defining a collar that at least partially surrounds said top end of said drain pipe.

26. An automatic drain assembly according to claim 25, comprising at least two of said buoyant members in horizontally spaced apart relationship to provide spaces between said member s for inflow of said accumulated water into said top end of said drain pipe.

27. An automatic drain assembly according to claim 25 wherein said over is a generally flat plate with top and bottom surfaces, and said at least one buoyant member is secured to said bottom surface of said cover.

* * * * *